US006016615A

United States Patent [19]

Day

[11] Patent Number: 6,016,615

[45] Date of Patent: Jan. 25, 2000

[54] ATHLETIC SHOE SOLE

[76] Inventor: Richard Day, 50 N. Front St., Memphis, Tenn. 38103

[21] Appl. No.: 09/066,663

[22] Filed: Apr. 27, 1998

[51] Int. Cl.[7] ..... A43B 5/00; A43B 15/02

[52] U.S. Cl. ..... 36/134; 36/127; 36/67 D

[58] Field of Search ..... 36/134, 127, 67 D, 36/61

[56] References Cited

U.S. PATENT DOCUMENTS

| | | |
|---|---|---|
| 48,343 | 7/1865 | Hodgins . |
| 264,105 | 9/1882 | Rust . |
| 715,138 | 12/1902 | Pierce . |
| 919,082 | 4/1909 | Schaney . |
| 1,662,111 | 3/1928 | Halstead . |
| 1,696,619 | 12/1928 | Bell . |
| 4,375,729 | 3/1983 | Buchanen, III . |
| 4,590,693 | 5/1986 | Kawashima et al. . |
| 5,732,482 | 3/1998 | Remington et al. . |
| 5,737,855 | 4/1998 | Jordon et al. . |
| 5,768,809 | 6/1998 | Savoie . |
| 5,848,482 | 12/1998 | Bathum . |

FOREIGN PATENT DOCUMENTS

| | | |
|---|---|---|
| 1426358 | 12/1966 | France . |
| 229175 | 12/1910 | Germany . |
| 92018027 | 10/1992 | WIPO . |

*Primary Examiner*—Ted Kavanaugh
*Attorney, Agent, or Firm*—Todd B. Murrah

[57] ABSTRACT

An athletic shoe sole including a sole platform having a plate member slidably engaged therein for movement from a forward to a rearward position wherein the sole platform defines a plurality of ports for receiving a corresponding plurality of cleats. The cleats comprise a post having a flange attached to one end and a cleat base attached to the other. The flanges of each cleat, once inserted through the ports, passes through a corresponding plurality of key slots defined by the plate member. When the plate member is urged rearward, a slot portion of each key slot passes around the post and beneath the flange to secure the cleats to the sole platform. A threaded bolt is provided to urge the plate member between a forward and a rearward position. Bubbles are defined by the plate member about the key slot to lift the flange, post and cleat base upward and thereby urge the cleat base in pressed abutment with the sole platform. The present invention allows the user to quickly replace the cleats as required.

17 Claims, 6 Drawing Sheets

ATHLETIC SHOE SOLE

FIELD OF THE INVENTION

The present invention relates to athletic shoes and more particularly to athletic shoes using some form of spike or cleat. In greater particularity the present invention relates to athletic shoe soles having spikes or cleats that are detachably connected to the sole of the shoe.

BACKGROUND OF THE INVENTION

Athletic s hoes having detachable spikes have been known in the industry for a significant period of time. In most cases the spikes are detachable for purposes of replacement. As the user wears a spike or cleated shoe, the spikes eventually are worn down and become ineffective. This phenomena is particularly common with golfing shoes particularly in view that many golf courses preclude metal spikes and demand the use of plastic spikes.

In fact the design of golfing spikes has been altered so dramatically, the use of the word "spike" is no longer an accurate description of the device connected to the shoe. The "spikes" currently used on many golf shoes would be better described as a cleat. The cleats used on golf shoes today do not extend a great distance from the bottom of the sole and in many cases resemble flat disks having a plurality of ridges or posts thereon. The ridges and posts are relatively shallow, and as they are constructed of plastic, tend to wear very quickly. It is not uncommon for a player's cleats to require changing before the completion of an 18 hole round of golf.

The most common method of attaching and detaching plastic cleats to the bottom of a golf shoe is with the use of a threaded post connected to the cleat which is received in a threaded receptacle formed in the sole of the shoe. Special tools are used to screw in the cleats, and later unscrew the cleat 5 and remove the cleat 5 by the user. As cleats tend to wear uniformly, the operation of removing cleats from the bottom of a player's shoe can be very time consuming. Existing screw cleats sometimes strip their thread thus impairing removal. Threaded cleats are also notorious for coming loose during use. Time unfortunately is not something that an athlete has a great deal of while playing. An athlete may only have two or three minutes to change out his spikes during a game. Unfortunately current methods and tools for changing spikes may require as much as a half an hour of change time.

This inventor has conducted a search to determine what, if any, prior art exists relative to detachable cleats. The search revealed some patents for detachable cleats or spikes and also revealed patents for shoes having retractable spikes. The patents produced by this search are listed as follows:

| U.S. PAT. NO. | | INVENTOR |
|---|---|---|
| U.S. Pat. No. 2,118,113 | to | Schemel |
| U.S. Pat. No. 2,668,373 | to | Russo |
| U.S. Pat. No. 3,982,336 | to | Herro |
| U.S. Pat. No. 4,375,729 | to | Buchanen, III |
| U.S. Pat. No. 4,821,434 | to | Chein |
| U.S. Pat. No. 4,875,300 | to | Kass |
| U.S. Pat. No. 5,195,210 | to | Sink |
| U.S. Pat. No. 5,269,080 | to | Davis |
| U.S. Pat. No. 5,337,494 | to | Ricker |
| U.S. Pat. No. 5,497,565 | to | Balgin |
| U.S. Pat. No. 5,526,589 | to | Jordan |
| U.S. Pat. No. 5,638,615 | to | Korsen |
| U.S. Pat. No. 5,644,857 | to | Ouellette, et al. |

SUMMARY OF THE INVENTION

As herein described, there is provided an improved athletic shoe sole for use with an athletic shoe body. The sole defines a plurality of ports defined therein which communicate with a sliding channel defined thereby and in which a plate member is slidably engaged for movement between a forward and a rearward position. A threaded bolt is rotatably connected to the shoe sole and threadably connected to the plate member for selectively urging the plate member between the forward and rearward positions. A plurality of cleats are provided for insertion into the ports. A plurality of key slots comprising a hole and communicated slot are defined by the plate member.

The cleats include an elongated post having a flange attached to one end and a cleat base attached to an opposite end. The flange and post are inserted within the port such that the flange passes through a key slot hole when the plate member is in the forward position. When the cleats have been inserted into their corresponding ports, the bolt is rotated to urge the plate member to the rearward position such that the slot of each key slot is moved about the post and beneath the flange thus securing the cleats to the sole of the shoe. The cleat base has a diameter larger than the port to prevent passage of the cleat base within the port.

Bubbles are defined by the plate member each about one of the plurality key slots such that the typically planar surface of the plate member rises at a predetermined grade along the length of each slot. In operation movement of the plate member from the forward to the rearward position will urge each bubble in contact with the corresponding flange thus urging the flange upward as each post is received within the corresponding slot. This movement causes the cleat base to move in secured and pressed abutment with the shoe sole thus stabilizing the cleat base in a fixed position.

The primary object of the present invention is to provide a quick and easy method for quickly attaching and detaching cleats from the bottom of an athletic shoe. Another advantage of the invention is that the components of this invention are simple and economically efficient to manufacture. Another benefit of the present invention is that the invention accomplishes the foregoing objectives while minimizing the space necessary for the working components of this invention. This benefit is important particularly with golf shoes which are very thin and designed more for appearance than function. The present invention accommodates use with even the dressiest of golf shoes. Lastly the present invention accommodates the comfort of the user by offering more foot support due to the firmness of the plate member. The plate member embedded in the sole of the shoe can be constructed of a lightweight, flexible metal which is unnoticeable to the user while walking.

BRIEF DESCRIPTION OF THE DRAWINGS

Apparatus embodying features of my invention are depicted in the accompanying drawings which form a portion of this disclosure and wherein.

DESCRIPTION OF THE PREFERRED EMBODIMENT

Figure 1:
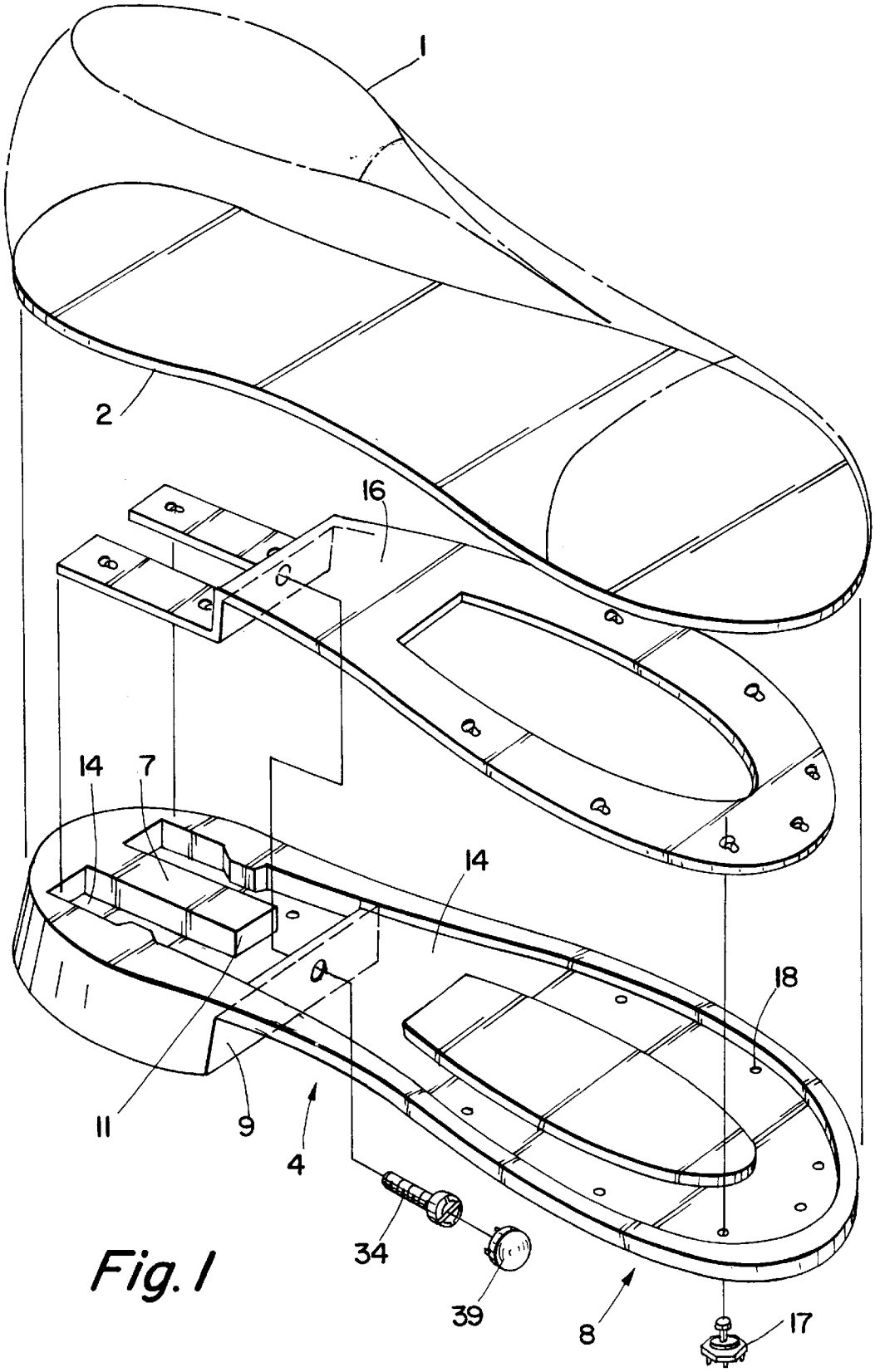
FIG. 1 is an exploded perspective view of the present invention.
Figure 2:
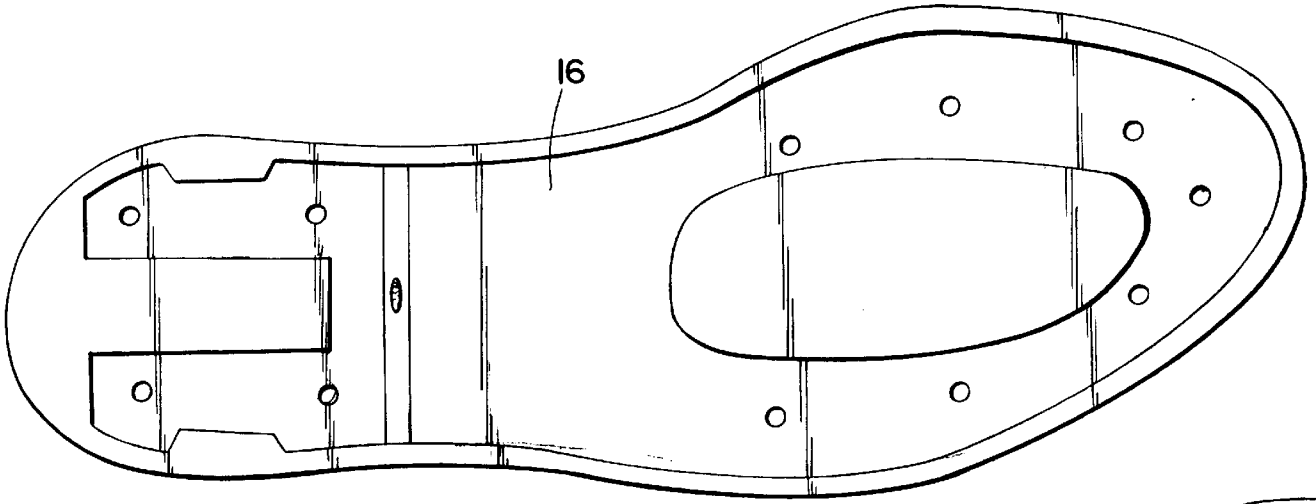
FIG. 2 is a top plan view of the lower layer of the present invention.
Figure 3:
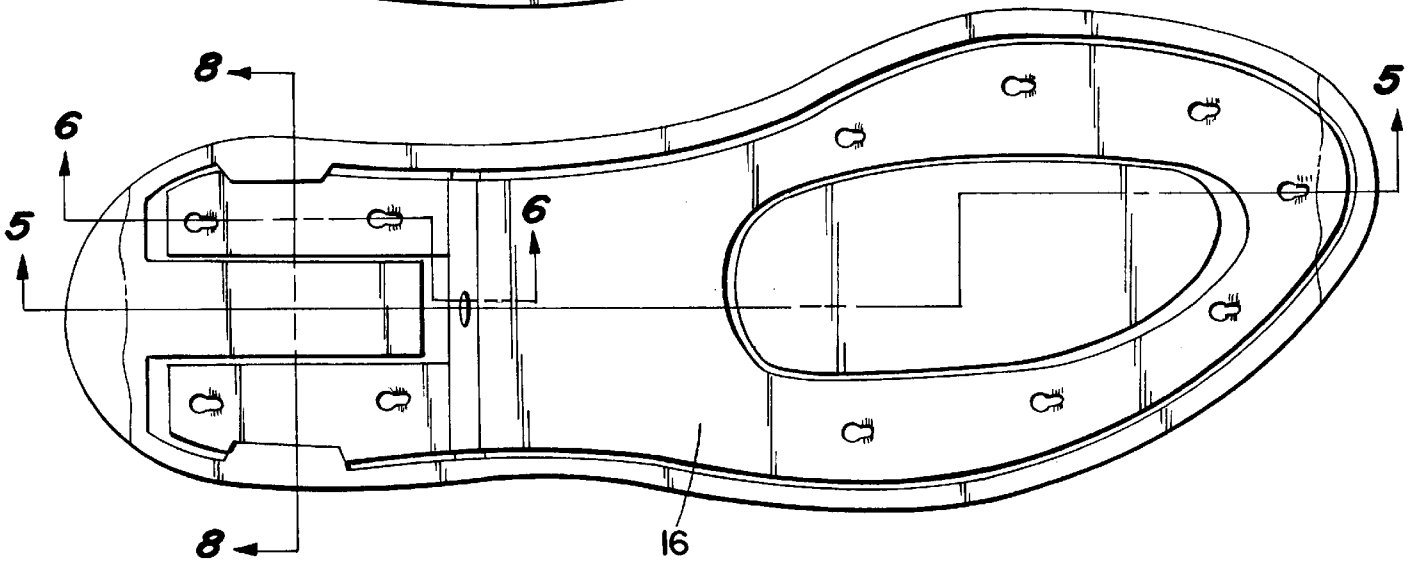
FIG. 3 is a top plan view of the lower layer of the present invention with the plate member slidably engaged therein.
Figure 4:
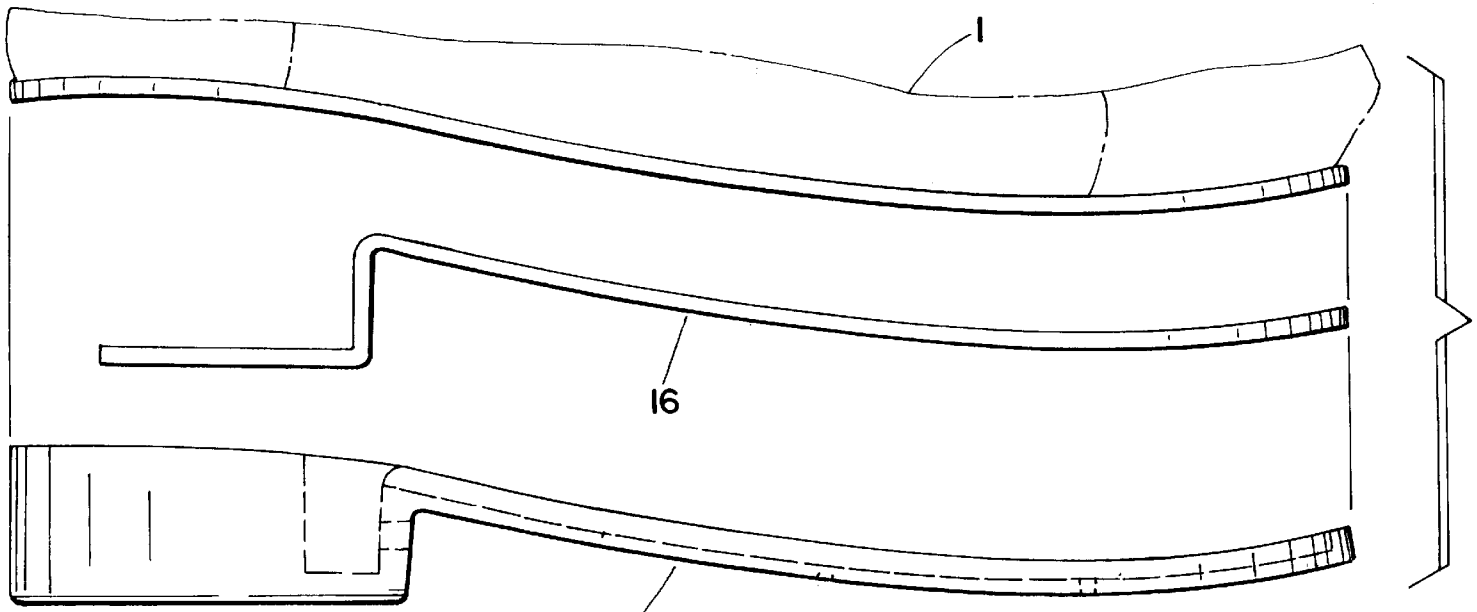
FIG. 4 is an exploded side view of the lower layer, upper layer and plate member embodied in the present invention.
Figure 5:
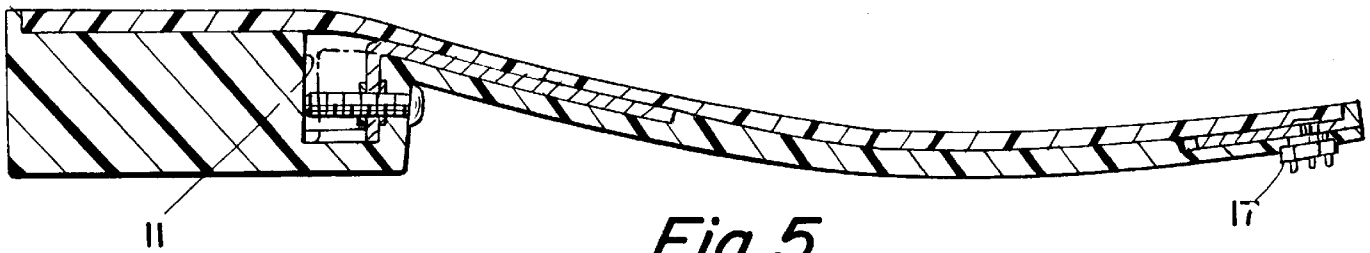
FIG. 5 is a sectional view taken along line 5—5 of FIG. 3.

Referring to FIGS. 1–11 of the drawing for a clearer understanding of the invention, it should be noted that the preferred embodiment of the invention includes a sole platform 1 which is typically connected to a shoe body 2. The shape and size of the shoe body 2 may vary and is not part of the invention though, of course, required for the invention to function. The sole platform 1 includes an upper layer 3 connected to the shoe body 2 and a lower layer 4 connected to the upper layer 3 subjacent thereto. The lower layer 4 extends in substantially parallel planar relation to the upper layer 3. The lower layer 4 defines a heel support 7 located subjacent the rear of the upper layer 3. The lower layer 4 includes a forward panel 8 which extends from the front of the sole platform 1 toward the rear thereof to a point spaced a predetermined distance from the heel support 7. The lower layer 4 further includes a front panel 9 which is integrally connected to the forward panel 8 and depends therefrom in substantially parallel spaced relation to a forward face 11 of the heel support 7. The lower layer 4 further includes a rearward panel 12 integrally connected to the front plate 9 and heel support 7. The lower layer 4 defines a slide channel 14 in which a plate member 16 is slidably engaged for movement between a forward position shown in FIG. 6 and a rearward position shown in FIG. 7.

As will be described herein, plate member 16 is primarily designed to detachably secure a plurality of cleats 17. The lower layer 4 defines a plurality of ports 18 extending therethrough in communication with the slide channel 14. The plate member 16 defines a plurality of key slots 19. Each key slot includes a hole 21 and a slot 22 disposed in communication with the hole 21. The width of the slot 22 (shown as A) is less than the diameter of the hole 21. The plate member 16 includes a plurality of bubbles 23 each formed by the plate member 16 around each slot 22 such that the generally planar surface of the plate member 16 rises at a predetermined grade from an end of each slot 22 adjacent said hole 21 to and around an end of each slot 22 opposite the hole 21.

Figure 9:
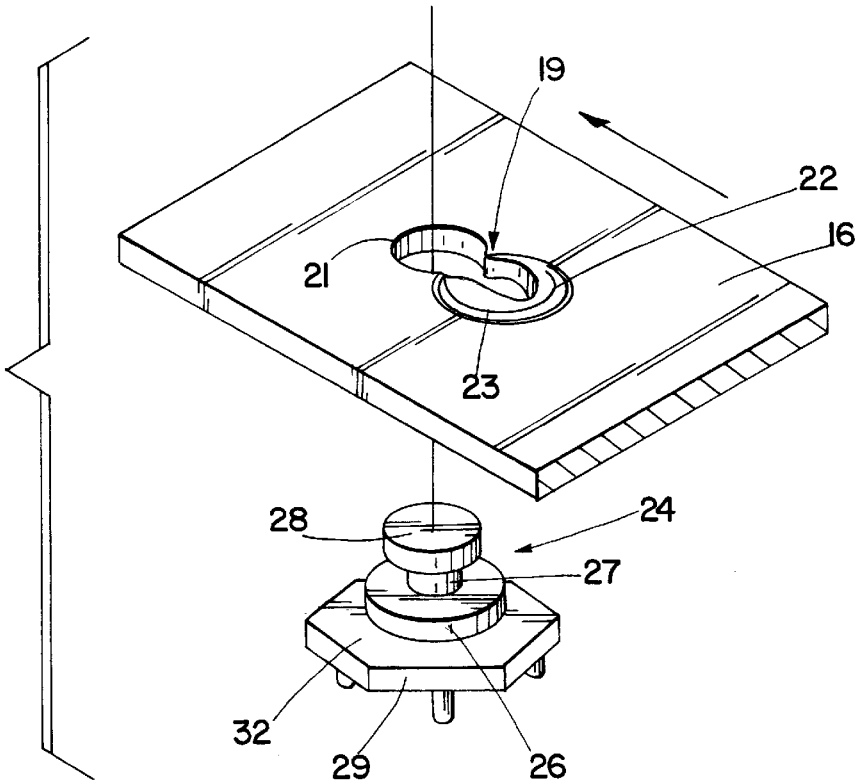
FIG. 9 is an exploded detailed view of a cleat, a portion of the plate member and a key slot defined thereby.
Figure 10:
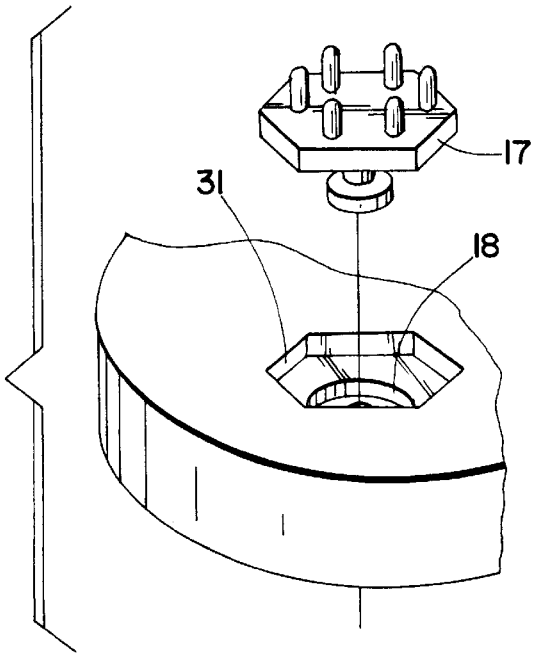
FIG. 10 is a detailed exploded view of a cleat, cleat base receptacle and a portion of the lower layer.
Figure 11:
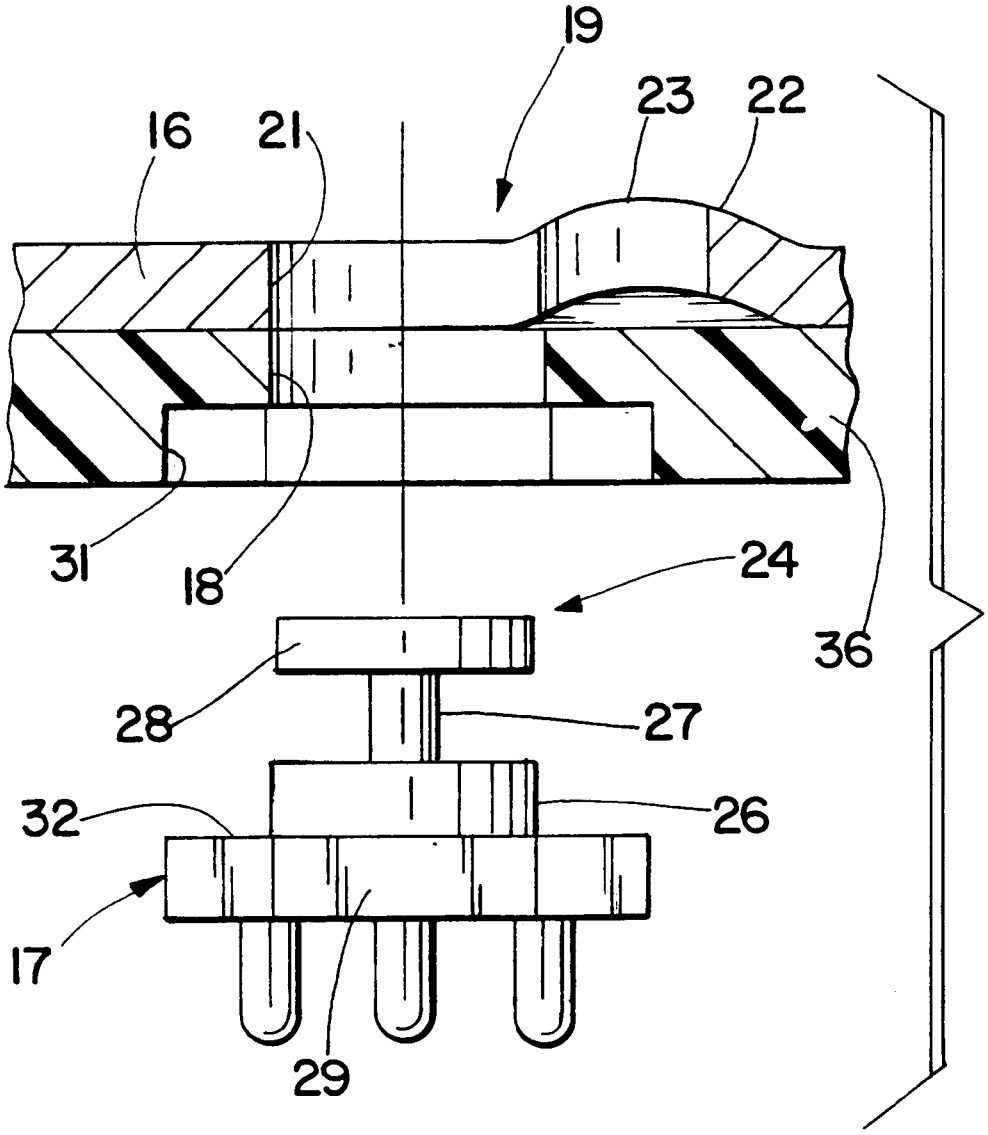
FIG. 11 is a detailed, exploded, side view, of the cleat, lower layer, slide plate, and key slot of the present invention.

As shown in FIGS. 9–11, each cleat 17 includes an elongated post 24 which further includes a main post 26 and a locking post 27. The main post 26 has an external diameter substantially the same as the internal diameter of the ports 18. The locking post 27 has an external diameter smaller than the main post 26 and substantially the same as the width A of the slot 22. A flange 28 is connected to the post 24 and more particularly to the locking post 27 in coaxial relation thereto. A cleat base 29 is connected to the post 24 and more particularly to the main post 26 in coaxial relation thereto. The cleat base 29 defines a diameter larger than the internal diameter of the ports 18. The lower layer 4 defines a plurality of cleat base recepticals 31 each positioned in coaxial relation to one of the plurality of ports 18 with each cleat base receptacle 31 having a shape substantially the same as an upper surface 32 of a cleat base 29.

A bolt 33 is rotatably connected to the front plate 9 of the lower layer 4 and is threadably connected to a vertical portion 34 of the plate member 16. The plate member 16 includes a primary portion 36 extending substantially above the front panel 9 forward of the heel support 7. The vertical portion 34 is integrally connected to the primary portion 36 in perpendicular relation thereto and extends vertically downward therefrom in substantially parallel relation to the forward face 11 of the heel support 7. The plate member 16 further includes a heel portion 37 integrally connected to the vertical portion 34 in perpendicular relation thereto and extending horizontally therefrom around the heel support 7. A threaded nut 38 is connected to the vertical portion 34 of the plate member 16 and threadably engages the bolt 33.

Figure 6:
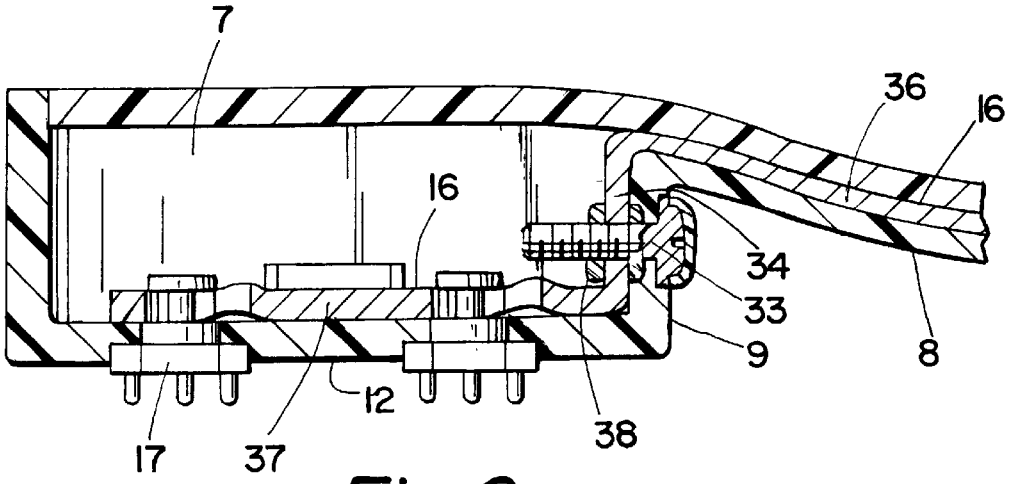
FIG. 6 is a sectional view taken along line 6—6 of FIG. 3 with the plate member urged to a forward position.
Figure 7:
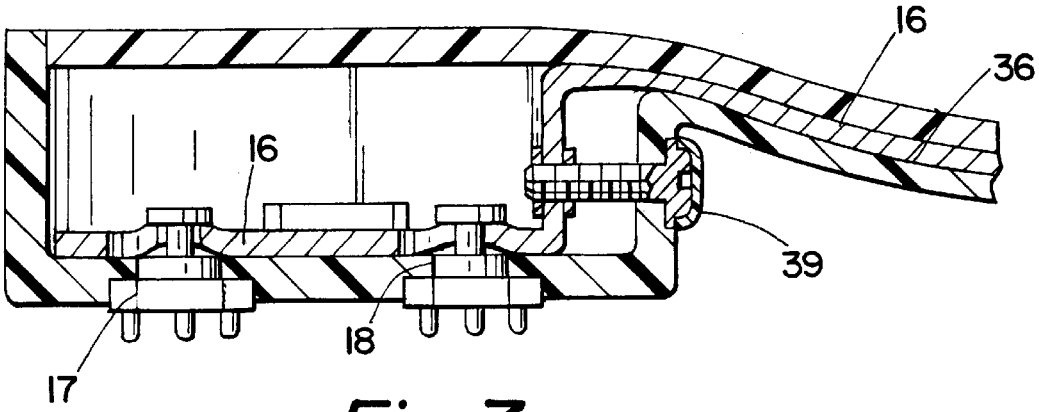
FIG. 7 is a sectional view taken along line 6—6 of FIG. 3 showing the slide plate urged to a rearward position.
Figure 8:
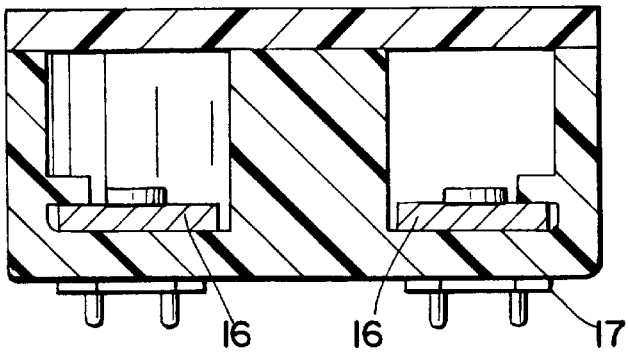
FIG. 8 is a sectional view taken along line 8—8 of FIG. 3.

As shown in FIGS. 6-7 the cleats 17 are detachably connected to the sole platform 1 by rotating the bolt 33 in a predetermined direction to urge the plate member 16 to the forward position. As shown in FIGS. 6–11, each cleat 17 is inserted through a port 18 such that the main post 26 is seated within the port 18. As the external diameter of the main post 26 and the internal diameter of the port 18 are substantially the same, the post 24 is firmly secured within the lower layer 4. The locking post 27 extends within the slide channel 14 and through the hole 21 of the key slot 19. The flange 28 is positioned above the hole 21.

Typically the shoe body 2 and sole platform 1 are held in an inverted position while the cleats 17 are being inserted. Once all the cleats 17 have been inserted within their corresponding ports 18, the bolt 33 is rotated counter the predetermined direction to urge the plate member 16 to the rearward position. As the plate member 16 is urged to the rearward position each slot 22 is urged around each locking post 27 and beneath each flange 28 thus securing the cleats 17 to the sole platform 1. As the plate member 16 is urged to the rearward position, each bubble 23 is urged against a corresponding flange 28 thus lifting the flange 28 upward and thereby urging the cleat base 29 within the cleat base receptacle 31 and in pressed abutment with the lower layer 4 of the sole platform 1.

In the preferred embodiment, the main post 26, the flange 28, port 18 and the hole 21 are substantially circular in cross section. It is however contemplated by this inventor that these components could be designed in any shape and particularly polygonal such that the main post 26 would be engaged by the port 18 in fixed relation thereto to prevent rotation of the post 24 and cleat base 29. As is shown in FIGS. 10-11, the cleat base 29 and the cleat base receptacle 31 are polygonal for that reason. It is equally contemplated by this inventor that the cleat base receptacle 31 and cleat base 29 could be designed in a cross-sectionally circular fashion to minimize manufacturing costs. Once the plate member 16 has been urged to the rearward position, a lock cap 39 can be detachably connected to the bolt 33 and received within a plurality of notches, 41 defined by front panel 9, to lock the bolt 33 in a non-rotating position.

While I have shown my invention in one form, it will be obvious to those skilled in the art that it is not so limited but is susceptible of various changes and modifications without departing from the spirit thereof.

What I claim is:

1. A shoe sole comprising:

(a) a sole platform;

(b) a plate member slideably engaged within said sole platform for sliding movement between a forward position and rearward position and defining a plurality of key slots;

(c) a plurality of cleats received within a plurality of ports and defined by said sole platform and detachably engaged by said plate member when said plate member is urged in a predetermined direction; and (d) means connected to said sole platform for urging said plate member between said forward and rearward positions, wherein said plate member defines a plurality of raised bubbles each about and defining one of said key slots such that the typically planner surface of said plate member rises at a predetermined grade along each of said key slots.

2. A shoe sole as described in claim 1 wherein each said cleat comprises:

a. an elongated post;

b. a flange connected to one end of said post in coaxial relation thereto; and c. a cleat base connected to said post opposite said flange and defining a diameter larger than the diameter of one of said plurality of ports such that said flange and said post may be inserted into one of said ports at a predetermined distance limited by the contact of said cleat base with said sole platform and wherein said flange will extend through and above a hole formed by said key slot and wherein sliding movement of said plate member from said forward to said rearward position will urge a slot partially formed by each said key slot about said post and beneath said flange, wherein said bubble will contact said flange and urge said flange upward thereby lifting said cleat base in secured abutment with said sole platform.

3. A shoe sole as described in claim 2 wherein said post comprises:

a. A main post connected to said cleat base and having an external diameter substantially the same as the internal diameter of one of said plurality of ports; and b. A locking post connected to said main post and said flange in coaxial relation to both said main post and said flange and wherein said locking post has an external diameter smaller than the external diameter of said main post and substantially equal to the width of said slot such that movement of said plate member from said forward position to said rearward position will urge said slot about said locking post and between said flange and said main post thereby securing said cleat within said sole platform.

4. An athletic shoe sole connected to and used in conjunction with an athletic shoe body wherein said shoe sole comprises a sole platform connected to in supporting said shoe body and defining a plurality of ports wherein said sole platform includes an upper layer connected to said shoe body, and a lower layer connected to said upper layer adjacent thereto and defining said plurality of ports and wherein said lower layer defines a slide channel in which said securing means is slidably engaged between said upper layer and said lower layer; a plurality of cleats, each partially inserted within one of said plurality ports and partially extending, below said sole platform, wherein said plurality of cleats includes an elongated post, a substantially planner flange connected to said post in coaxial relation thereto and having a diameter less than said hole and larger than said slot, and a cleat base connected to said post, opposite said flange, wherein said flange and post made be received within said port and wherein said flange may pass through said hole and above said plate member when said plate member is in a forward position such that sliding movement of said plate from said forward position to a rearward position will urge said hole away from said post and will urge said slot adjacent to and about said post and beneath said flange to detachably connect said cleat to said sole platform; means engaged within said sole platform and capable of sliding movement for detachably securing said plurality of cleats to said sole platform, wherein said securing means comprises a plate member slidably seated within said slide channel and defining a plurality of key slots for receiving said plurality of cleats, wherein each one of said key slots defines a hole and a slot in communication with said hole wherein said hole has a larger diameter than said slot; and means for lifting each of said plurality of cleats in pressed abutment with said lower layer.

5. An athletic shoe sole as described in claim 4 wherein said lifting means comprises a plurality of bubbles, each formed by said plate member around and including each said slot such that the generally planar surface of said plate member rises at a predetermined grade from an end of each said slot adjacent said hole to and around an end of each said slot opposite said hole such that sliding movement of said plate member to said rearward position will urge said flange, post and cleat base upward and said cleat base in pressed abutment with said lower layer.

6. An improved athletic shoe sole as described in claim 5 comprising a plurality of cleat base receptacles defined by said lower layer in coaxial relation to each said post for receiving said cleat base.

7. An athletic shoe sole as described in claim 6 wherein said cleat base and said cleat base receptacle define a polygonal circumference to prevent rotation of said cleat relative to said lower layer.

8. An improved athletic sole as described in claim 4 wherein said securing means comprises a plate member slidably seated within said sole platform.

9. An athletic shoe sole as described in claim 8 further comprising means for selectively urging said plate member in sliding movement within said sole platform between a forward position and a rearward position.

10. An athletic shoe sole as described in claim 9 wherein said urging means comprises a bolt rotatably connected to said sole platform and threadably connected to said plate member.

11. An athletic shoe sole as described in claim 4 where in said lower layer comprises a heel support connected to said upper layer and extending downwardly therefrom.

12. An athletic shoe sole as described in claim 11 wherein said plate member comprises:

a. a primary portion extending in substantially parallel planar relation to said upper layer forward of said heel support;

b. a vertical portion integrally connected to said primary portion in perpendicular relation thereto and extending vertically downward therefrom in substantially parallel planar relation to a vertical forward face defined by said heel support; and c. a heel portion integrally connected to said vertical portion in perpendicular relation thereto and extending horizontally therefrom around said heel support.

13. An athletic shoe sole as described in claim 12 wherein said lower layer comprises a forward plate in substantially parallel and spaced relation to said forward face of said heel support.

14. An athletic shoe sole as described in claim 13 further comprising means for selectively urging said plate member in sliding movement within said slide channel between a forward position and a rearward position.

15. An athletic shoe sole as described in claim 14 wherein said urging means further comprises a bolt rotatably connected to said forward plate and threadably connected to said vertical portion.

16. An athletic shoe sole as described in claim 15 further comprising means for locking said bolt in a non-rotating position.

17. A shoe sole as described in claim 4 wherein each said cleat base defines a polygonal circumference dispose in coaxial relation to said post and said flange Wherein said lower layer defines a plurality of cleat base receptacles which are polygonal in circumference and wherein each of said cleat base receptacles are disposed in coaxial relation to a correspondent port such that each said polygonal cleat base is received within a corresponding cleat base receptacle in fixed nonrotational relation thereto.

* * * * *